US005089097A

United States Patent [19]

Goto et al.

[11] Patent Number: 5,089,097

[45] Date of Patent: Feb. 18, 1992

[54] ELECTROLYTIC METHOD FOR RECOVERING SILVER FROM WASTE PHOTOGRAPHIC PROCESSING SOLUTIONS

[75] Inventors: Nobutaka Goto; Shigeharu Koboshi; Naoki Takabayashi, all of Hino; Yoshiyuki Makida, Gifu, all of Japan

[73] Assignee: Konica Corporation, Tokyo, Japan

[21] Appl. No.: 491,509

[22] Filed: Mar. 12, 1990

[30] Foreign Application Priority Data

Mar. 17, 1989 [JP] Japan ..... 1-66995
Mar. 17, 1989 [JP] Japan ..... 1-66996

[51] Int. Cl.[5] ..... C25C 1/20
[52] U.S. Cl. ..... 204/109; 204/129; 204/130
[58] Field of Search ..... 204/109, 129, 130

[56] References Cited

U.S. PATENT DOCUMENTS 4,111,766 9/1978 Idota et al. ..... 204/109
4,129,441 12/1978 Kunda et al. ..... 75/353

*Primary Examiner*—John Niebling
*Assistant Examiner*—David G. Ryser
*Attorney, Agent, or Firm*—Frishauf, Holtz, Goodman & Woodward

[57] ABSTRACT

The improved method and apparatus for recovering silver from a waste photographic processing solution, in which the waste solution is supplied into the cathode compartment of an electrolytic cell which is separated from an anode compartment by a diaphragm, and electrolysis is performed with the current density at cathode and the current concentration in the cathode compartment controlled in such a way that silver ions are reduced in said waste solution with the hydrogen bubbles evolved by electrolytic reaction, and the reduced silver ions are precipitated as silver grains in the waste photographic processing solution.

11 Claims, 6 Drawing Sheets

ELECTROLYTIC METHOD FOR RECOVERING SILVER FROM WASTE PHOTOGRAPHIC PROCESSING SOLUTIONS

BACKGROUND OF THE INVENTION

The present invention relates to a method and apparatus for recovering silver from waste photographic processing solutions by reducing silver ions and allowing them to be precipitated as silver grains.

Waste photographic processing solutions such as bleach-fixing baths and fixing baths that have been used to process photosensitive materials contain silver in high concentrations. High silver contents have the great potential to cause to environmental pollutions but on the other hand they are valuable resources. Thus, it is a recent practice in the art to recover silver from waste photographic processing solutions. There are various ways in which silver can be recovered from waste photographic processing solutions and they may be roughly classified as the following three types:

A. Reduction with chemicals

In this method, waste photographic processing solutions are treated with a reducing agent such as formic acid, oxalic acid, hydrazine or sodium borohydride ($NaBH_4$), a sulfidizing agent such as sodium sulfide or sodium hydrogen sulfide, or an oxidizer such as hydrogen peroxide, so that the silver ions in the waste solutions are reduced, sulfidized or oxidized to form a silver, silver sulfide or silver oxide precipitate, which is then recovered.

B. Substitutional reduction with metals

In this method, a base metal such as zinc or aluminum that is less noble (lower in redox potential) than silver is added in either a powder, granular, ribbon or wire form to waste photographic processing solutions, so that the dissolved silver ions are reduced by replacement with said base metal, whereafter they are recovered as a silver powder.

C. Electrolytic recovery

This is the most common method of silver recovery, in which the silver ions dissolved in waste photographic processing solutions are precipitated on a cathode by electrolytic reaction and thereafter, with the electrolyzer shut down, the silver deposit is separated and recovered from the cathode surface. A rotary drum or plane parallel plate type electrolytic cell is typically used.

The above-described conventional methods have various disadvantages. In method A (reduction with chemicals), the use of expensive reducing agents (e.g. formic acid and sodium borohydride) or oxidizers (e.g. hydrogen peroxide) increases the operating cost and hence the cost of silver recovery. The addition of reducing agents presents a special problem in that the desilvered waste solution from which silver has been recovered must be subjected to various treatments (e.g. pH adjustment and COD removal) before it can be disposed of. To this end, the chemicals adhering to the precipitated silver must be washed off with a suitable chemical. Further, this method is not suitable for continuous operation since the equipment must be shut down before silver recovery is started. Another problem is that the need for providing facilities for adding various chemicals and recovering the precipitated silver powder adds to the complexity of the overall equipment.

Similar drawbacks have been pointed out in method B or substitutional reduction with metals.

In method C (electrolytic recovery), the silver reduced is deposited like a plate on the cathode, so in order to recover it, the electrolytic operation has to be interrupted and the deposited silver must be forcefully separated from the cathode surface by some physical means, resulting in a vary low operational efficiency. In short, the conventional method of silver recovery which relies upon the precipitation of silver on the cathode surface by electrolysis has suffered the disadvantage of low efficiency of silver recovery.

A further problem with method C is that if sulfides such as $H_2S$, $S^{2-}$ and $SH^-$ are generated by anodic oxidation of thiosulfate ions in waste photographic processing solutions, silver ions will react with these sulfides to become silver sulfide, which is present in such a fine particulate form that it is very difficult to recover. To avoid this problem, the generation of sulfides must be prevented by performing electrolysis at a reduced current density at both anode and cathode. In other words, it becomes necessary to use an electrolytic cell having a large electrode area but then the overall size of the equipment will accordingly increase.

In electrolysis with a rotary cathode drum type electrolytic cell, the diffusibility of the electrolyte is enhanced to break up the thin layer, such as an electrical double layer, having high resistance to diffusion that is formed on the cathode surface, whereby the percentage of silver recovery and the current efficiency are improved. A problem with this approach is that the operating cost is increased because of the higher power consumption necessary to rotate the drum in the solution in the electrolytic cell and because frequent maintenance work is required to deal with such problems as the wear of electrical connections to the drum.

The present invention has been accomplished under the circumstances described above. Its principal object is to provide a method of recovering silver from waste photographic processing solutions by which the dissolved silver ions can be reduced to silver grains in the waste solution without requiring any special means such as the addition of chemicals. Another object of the present invention is to provide an apparatus that is suitable for implementing said method and which is capable of recovering silver from waste photographic processing solutions without stopping its operation.

The first object of the present invention is attained by a method which comprises supplying a waste photographic processing solution into the cathode compartment of an electrolytic cell which is separated from an anode compartment by a diaphragm, performing electrolysis with the current density at the cathode and the current concentration in cathode compartment controlled in such a way that silver ions are reduced in said waste photographic processing solution with the hydrogen bubbles evolved by electrolytic reaction, and precipitating the reduced silver ions as silver grains in the electrolyte.

The second object of the present invention is attained by an apparatus for recovering silver from a waste photographic processing solution in an electrolytic cell divided into a cathode compartment and an anode compartment by a diaphragm, which apparatus comprises means by which electrolysis is performed with the current density at cathode and the current concentration in the cathode compartment controlled in such a way that silver ions are reduced in the waste photographic processing solution supplied into the cathode compartment by means of the hydrogen bubbles evolved by electrolytic reaction and are thereafter precipitated as silver grains in the electrolyte, and means for separating and recovering the precipitated silver grains.

DETAILED DESCRIPTION OF THE INVENTION

Figure 1:
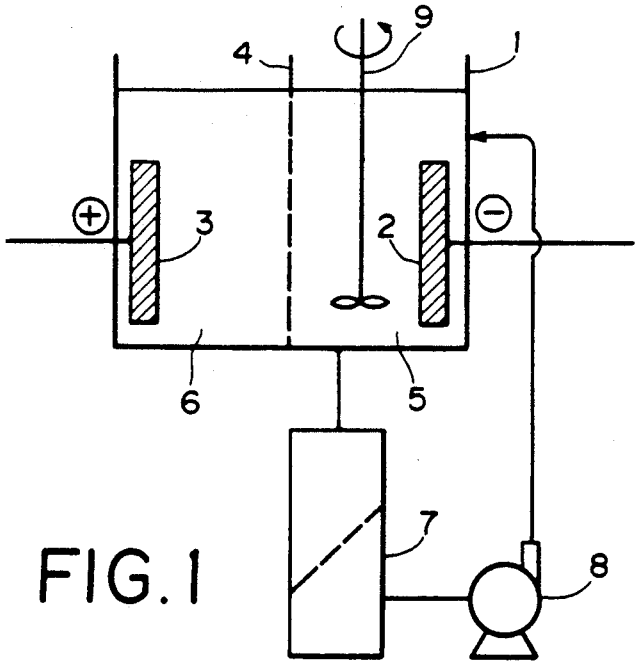
FIG. 1 shows schematically an apparatus for recovering silver from a waste photographic processing solution.

The present invention is described below in detail.

The present invention relates to an improvement of the conventional electrolytic method for reducing silver ions so that they are precipitated as metallic silver. In the present invention, silver which would be precipitated by electrolysis on the surface of a cathode under ordinary electrolytic conditions is precipitated in a waste photographic processing solution as grains grown to a predetermined size with the occurrence of little, if any, precipitation on the cathode plate, so that the silver can be easily recovered from the waste solution.

The components of the electrolytic cell used to implement the process of the present invention are described below with reference to FIG. 1. A cathode 2 in an electrolytic cell 1 is preferably made of a material that has a sufficiently low overvoltage to have the reaction for hydrogen generation proceed in preference over the reaction for silver precipitation by electrolysis or the reaction for the reduction of thiosulfate ions. Examples of such a material are carbonaceous materials such as graphite and activated carbon, which may be used either on their own or after being coated small amounts of with catalysts that facilitate hydrogen evolution, such as platinum group metals (e.g., platinum, palladium, rhodium and iridium) and oxides thereof. Two reactions, one for the precipitation of silver by electrolysis and the other for the evolution of hydrogen, occur on the cathode surface during the electrolytic reduction of waste photographic processing solutions. Since these reactions compete with each other, the following three conditions must be satisfied in order to prevent the precipitation of silver on the cathode surface. One condition is to use a cathode material that selectively has a low overvoltage for hydrogen generation so that the latter will proceed in preference over the reaction for the precipitation of silver by electrolysis. Second, it is necessary to select electrolytic conditions that are capable of substantially selective generation of hydrogen through proper adjustments of pH, temperature, concentration and other parameters. It is also necessary to select electrolytic conditions that will cause silver to be precipitated not in plate form but as needle crystals. The needles will not grow in size since they break in the electrolyte; therefore, they are by no means detrimental to continuous operation of the apparatus of the present invention.

The carbonaceous materials such as graphite and activated carbon that are to be used in the present invention have a low overvoltage for hydrogen generation, so the reaction for hydrogen generation will predominate over the reaction for silver precipitation on the cathode surface, whereby the precipitation of silver on the cathode surface and formation of silver sulfide are effectively prevented.

In the present invention, the solution in the cathode compartment is preferably agitated so that small hydrogen bubbles generated on the cathode surface diffuse throughout the inner space of the cathode compartment to enhance the efficiency of contact with silver ions, and this is effective for the purpose of increasing the current efficiency in the cathode compartment and hence the efficiency of silver recovery. The fine hydrogen bubbles to be generated preferably have a diameter of 5 $\mu$m or below, more preferably 3 $\mu$m or below, and most preferably 1 $\mu$m or below.

Figure 2:
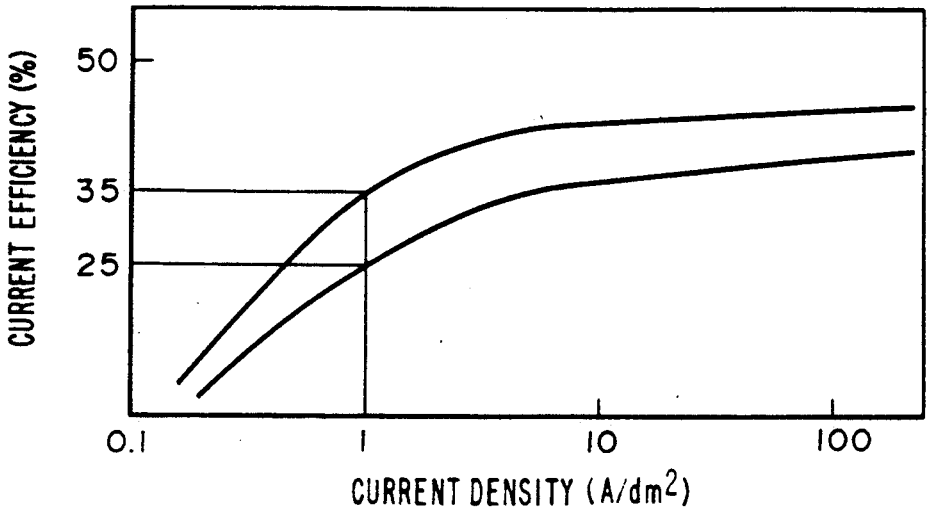
FIG. 2 is a graph showing the relation between current efficiency and the current density at cathode.
Figure 3:
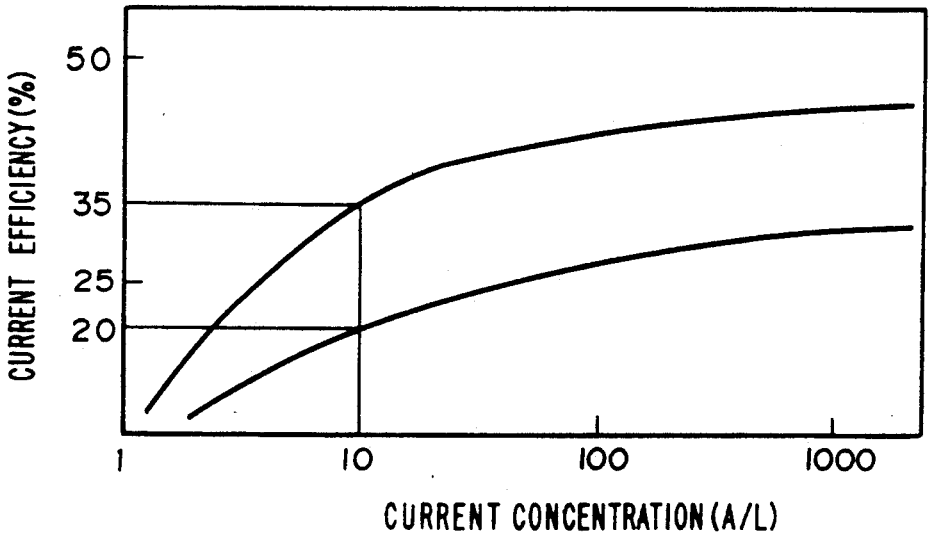
FIG. 3 is a graph showing the relationship between current efficiency and the current concentration in cathode compartment.

In order to effectively inhibit the precipitation of silver on the cathode surface by electrolysis, the current density at cathode and the current concentration in the cathode compartment are increased as shown in FIGS. 2 and 3 so that the rate of hydrogen generation is sufficiently increased to prevent the precipitation of silver and the formation of silver sulfide on the cathode plate by making it difficult for the silver ions or thiosulfate ions being precipitated to approach the area in the vicinity of the cathode. To this end, electrolysis is preferably performed with the current density at cathode being held at 1 A/dm$^2$ or above, more preferably at 10 A/dm$^2$ or above, and with the current concentration in the cathode compartment being held at 10 A/L or above, more preferably at 100 A/L or above.

The material of which the anode 3 is made is not limited in any particular way and may be selected from among those which are conventionally used in the art, such as a dimensionally stable electrode (DSE), a graphite electrode, a platinum electrode, a platinum-plated electrode, etc.

In constructing electrolytic cell 1 using cathode 2 and anode 3, the cell must be divided into cathode compartment 5 and anode compartment 6 by a diaphragm 4. This is for insuring that the gas evolved at the anode will not flow into the cathode compartment. In the present invention, silver is reduced in the cathode compartment to form particles which are fluidized in the cathode compartment. If these silver particles enter the anode compartment, they are oxidized and re-dissolved as silver ions. The other function of diaphragm 4 is to prevent this phenomenon. The use of the diaphragm offers the following additional advantages: the formation of $H_2S$, $S^{2-}$ and $SH^-$ on account of the anodization of thiosulfate ions in the waste photographic processing solution is prevented by proper selection of the material of diaphragm; the power consumption by the redox reaction of EDTA-Fe-$NH_4$ is minimized to enhance current efficiency.

In order to reduce its electric resistance, the diaphragm is preferably made of highly hydrophilic materials such as polyvinyl chloride, cotton, polypropylene, ceramics, glass, etc. Namely, an ion-exchange membrane, a sintered sheet of plastic fibers such as polypropylene fibers, polyvinyl chloride resin, Tetron® fabric, porous plate, a sintered plastic sheet, etc. may be used as a diaphragm.

The selection of a proper diaphragm is governed by its resistance (both electrical and liquid permeability) and a polypropylene (PP) fiber sintered sheet is preferably used as a diaphragm. Particularly preferred is a cation-exchange membrane that is permeable to ions but impermeable to the electrolyte. In this case, however, the anolyte which is separate from the catholyte must be supplied into the anode compartment of the electrolytic cell.

In the present invention, the diaphragm is preferably such as is permeable to ions but substantially impermeable to waste photographic processing solutions as well as to solvents. The expression "substantially impermeable" here referred to means either "entirely impermeable" or "hardly permeable"; concretely speaking, this shows, for example, that the amount of liquid permeation through the diaphragm is $$0.1\ \frac{\text{ml}}{\text{HR}\cdot\text{cm}^2}\cdot\frac{1}{\text{atm}}$$

or below. In this case, the electrical resistance of the diaphragm is preferably $$0.4\ \frac{\text{V}\cdot\text{cm}^2}{\text{mm}\cdot\text{Amp}}$$

or below.

That is to say, in the present invention the amount of liquid permeation through the diaphragm is preferably not higher than $$0.1\ \frac{\text{ml}}{\text{HR}\cdot\text{cm}^2}\cdot\frac{1}{\text{atm}},$$

more preferably not higher than $$0.01\ \frac{\text{ml}}{\text{HR}\cdot\text{cm}^2}\cdot\frac{1}{\text{atm}}.$$

The electric resistance of the diaphragm is preferably not higher than $$0.4\ \frac{\text{V}\cdot\text{cm}^2}{\text{mm}\cdot\text{Amp}},$$

more preferably not higher than $$0.02\ \frac{\text{V}\cdot\text{cm}^2}{\text{mm}\cdot\text{Amp}}.$$

By selecting these values for the amount of liquid permeation through the diaphragm and its electric resistance, it becomes possible for the diaphragm to prevent not only the inflow of $H_2S$, $S^{2-}$ and $SH^-$ into the cathode compartment due to the anodic oxidation of thiosulfate ions but also the inflow of thiosulfate ions from the cathode compartment into the anode compartment.

The electrolytic cell to be used in the present invention may be a diaphragm-free type which has no diaphragm provided between the anode and cathode compartments. In this case, the gas evolved at anode and various anodized products (i.e., oxides formed at anode) will intermingle by diffusion in the electrolyte, and the silver ions in the solution will undergo various reactions to form the fine particles of silver sulfide, silver oxide and silver, which are then separated from the solution.

By lowering the current density at anode, the discharge of $OH^-$ will become the predominant reaction that occurs at anode, to thereby prevent the formation of $H_2S$, $S^{2-}$ and $SH^-$ by anodic oxidation of thiosulfate ions.

Figure 7:
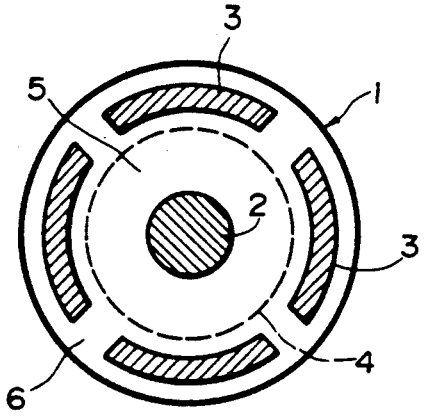
FIG. 7 is a plan view of a cylindrical electrolytic cell.
Figure 8:
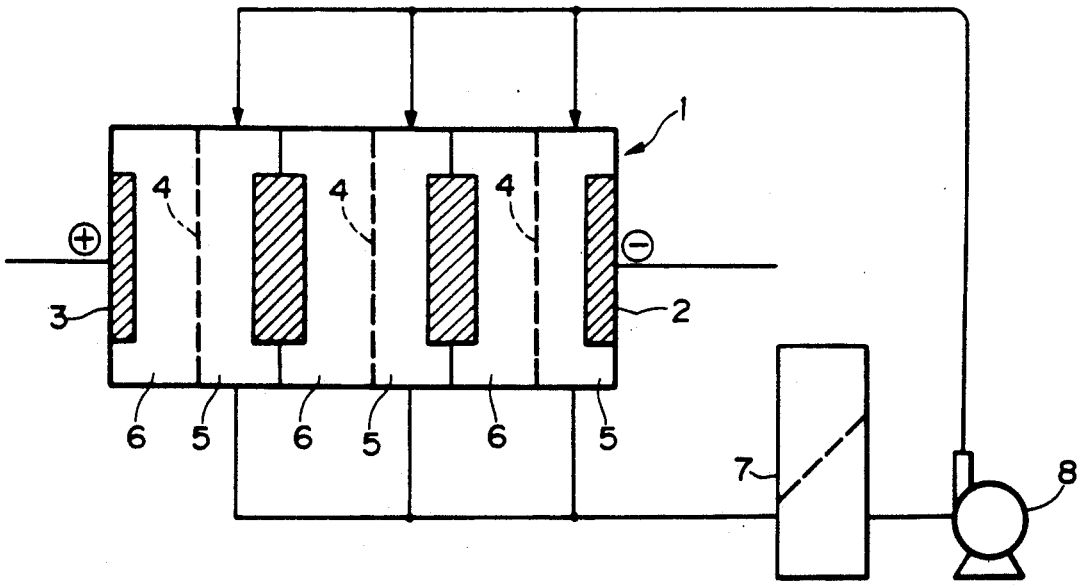
FIG. 8 shows schematically a bipolar electrolytic cell.
Figure 10:
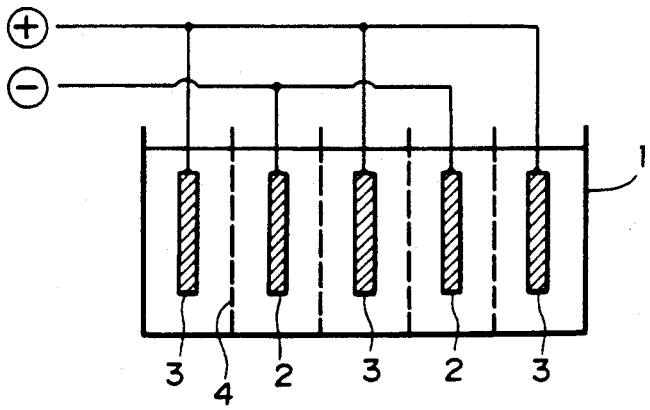
FIG. 10 shows schematically a unipolar electrolytic cell.

The electrolytic cell to be used in the present invention may be a box-shaped cell 1 that is divided into a cathode and an anode compartment by diaphragm 4 as shown in FIG. 1. Alternatively, it may comprise a tubular cell 1 that uses a cylindrical diaphragm 4 to divide its interior into an outer anode compartment 6 and an inner cathode compartment 5, as shown in FIG. 7. If desired, a box-shaped cell 1 is divided into more than two electrolytic compartments by a plurality of diaphragms 4 as shown in FIGS. 8 and 10, with the electrodes in the respective compartment being interconnected in a bipolar or unipolar way so as to insure that silver reduction can be performed in the plurality of cathode compartments.

During electrolysis, the catholyte is preferably kept in a fluidized state because by so doing, not only will the hydrogen bubbles evolved on the cathode surface diffuse in the solution effectively but also the silver grains generated in the catholyte will be dispersed and effectively suspended in the catholyte to promote the growth of silver grain size.

The electrolytic cell 1 is equipped with a circulation system composed of a filter 7 and a circulating pump 8. The circulating pump 8 is driven to maintain the fluidized state of silver grains in the cathode compartment and to have the silver grains be continuously recovered by means of the filter 7 through circulation.

Figure 11:
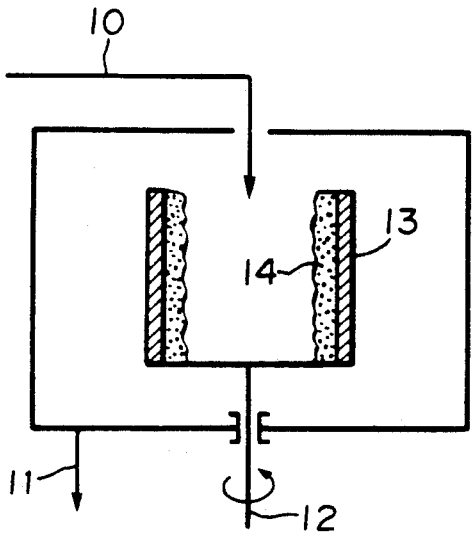
FIG. 11 shows schematically a cross section of a centrifugal separator.
Figure 12:
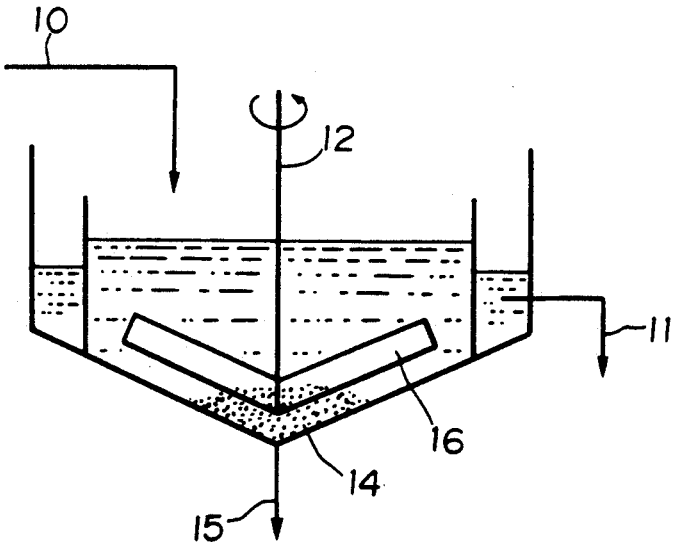
FIG. 12 shows schematically a cross section of a thickener.

In the present invention, the filter 7 may be replaced by a centrifugal separator or a thickener. One example of the centrifugal separator is shown in FIG. 11, and that of the thickener in FIG. 12. In FIG. 11, the waste photographic processing solution 10 is supplied into the centrifugal separator to adsorb silver grains 14 onto a filter media 13 which is rotated by a rotary motor 12, and are thereafter fed into the circulating pump 8 through passage 11. In FIG. 12, the silver grains 14 are precipitated by rotating a propeller 16 very slowly by means of a rotary motor 12, the precipitated silver grains being recovered through passage 15; the overflowing waste solution is fed into the circulating pump 8 through passage 11.

The electrolytic cell 1 is also equipped with an agitator 9, which agitates the catholyte to insure that the hydrogen bubbles evolved on the cathode surface will diffuse effectively or that the silver grains precipitated will be suspended in the catholyte.

If large silver grains are generated in the waste photographic processing solution, the chance of clogging of the filter 7 will decrease and continuous filtration can be achieved without frequent change of the filter medium. Generation of large silver grains in the waste photographic processing solution also contributes to a higher efficiency of separation by other methods.

In order to insure that the size of silver grains is sufficiently increased to facilitate their recovery, the residence time of waste photographic processing solution in the cathode compartment is adjusted to lie between 1 and 60 min. The residence time expressed in minutes can be determined by dividing the capacity (L) of cathode compartment by the flow rate of catholyte (L/min). If the residence time in the cathode compartment is extremely long, the silver grains crystallized will re-dissolve in the catholyte through chemical reaction or it becomes difficult to maintain the fluidized state of silver grains in the catholyte.

If two units of filter 7 are connected in parallel in such a way that they are selectively operated by changing valves or some other suitable means, the recovered silver grains can be taken out of the system without interrupting the electrolytic operation.

The following examples are provided for the purpose of further illustrating the present invention but are in no way to be taken as limiting.

EXAMPLE 1

A waste photographic processing solution having the formula shown below was treated with an apparatus shown in FIG. 1 having an electrolytic cell (for its design, see below) so as to recover silver from the waste solution. The current density and current concentration used in the electrolysis were varied and the current efficiency and the percentage of silver recovery were calculated by the equations shown below. The electrolysis was performed at room temperature and the temperature for electrolysis was not controlled in any particular way:

$$\text{Percentage of silver recovery} = \frac{\text{Amount of silver actually recovered (g)}}{\text{Amount of waste solution (L)} \times \text{Concentration of silver (g/L)}} \times 100$$

$$\text{Current efficiency} = \frac{\text{Amount of silver actually recovered (g)}}{\dfrac{\text{Current (A)} \times \text{Time of electrolysis (h)}}{26.5} \times 108} \times 100$$

Chief Components of Waste Photographic Processing Solution (resulting from the processing of photographic papers)

| | |
|---|---|
| Ammonium thiosulfate | ca. 70 g/L |
| Ammonium sulfite | ca. 18 g/L |
| EDTA-Fe—$NH_4$ | ca. 50 g/L |
| Silver ion | 8.32 g/L |
| pH | ca. 7.6 |

Electrolytic cell

Anode: graphite sheet
Cathode: graphite sheet
Diaphragm: PP fiber sintered sheet (thickness, 3 mm; porosity, ca. 60%; pore diameter, ca. 10 μm)

Cell size

Anode compartment: 50 $mm^W \times 50\ mm^L \times 100\ mm^H$ (anolyte, 250 ml)
Cathode compartment: 50 $mm^W \times 50\ mm^L \times 100\ mm^H$ (catholyte, 250 ml)

Figure 4:
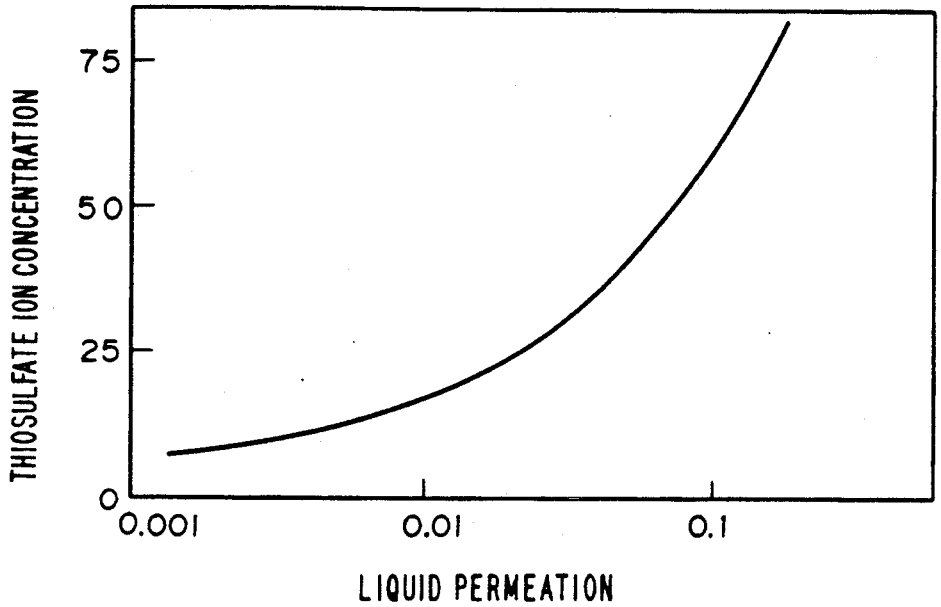
FIG. 4 is a graph showing the relationship between the amount of liquid permeation through a diaphragm and the concentration of thiosulfate ions.

The test results are shown in FIGS. 2–4. The percentage of silver recovery and current efficiency were calculated on the basis of the weight of silver trapped by the filter. Hence, the amount of silver precipitated like a plate on the cathode surface was not counted in calculating the current efficiency.

FIG. 2 shows the relationship between current efficiency and the current density at cathode for the two cases where the current concentration in the cathode compartment was 5 A/L and 20 A/L. As one can see from FIG. 2, the current efficiency for silver recovery was increased when the current density at cathode was at least 1 A/dm$^2$, preferably at least 10 A/dm$^2$, irrespectively of the current concentration in the cathode compartment. Stated more specifically, when the current density at cathode was 1 A/dm$^2$ and higher, the current efficiency was at least about 35% for a current concentration of 20 A/L, and at least about 25% for a current concentration of 5 A/L. Since an excessively high current efficiency will not contribute to any better efficiency of silver recovery, satisfactory results can be attained if the current density at cathode is at least 1 A/dm$^2$. The fact that an excessively high current efficiency will not contribute to any better efficiency of silver recovery may be explained by the concentration of silver ions in the waste photographic processing solution and is due to the chemical reduction of ingredients other than silver ions in the waste solution.

FIG. 3 shows the relationship between current efficiency and the current concentration in cathode compartment for the two cases where the current density at cathode is 1 A/dm$^2$ and 20 A/dm$^2$. Irrespective of the current density at cathode, the current efficiency increases with the increasing current concentration in cathode compartment, which is preferably at least 10 A/L, more preferably at least 100 A/L.

Similarly, when the current concentration was 10 A/L and higher, the current efficiency was at least about 35% for a current density at cathode of 20 A/dm$^2$, and at least about 20% for a current density at cathode of 1 A/dm$^2$. Since an excessively high current efficiency will not contribute to any higher percentage of silver recovery, satisfactory results can be attained if the current concentration in the cathode compartment is at least 10 A/L.

Figure 9:
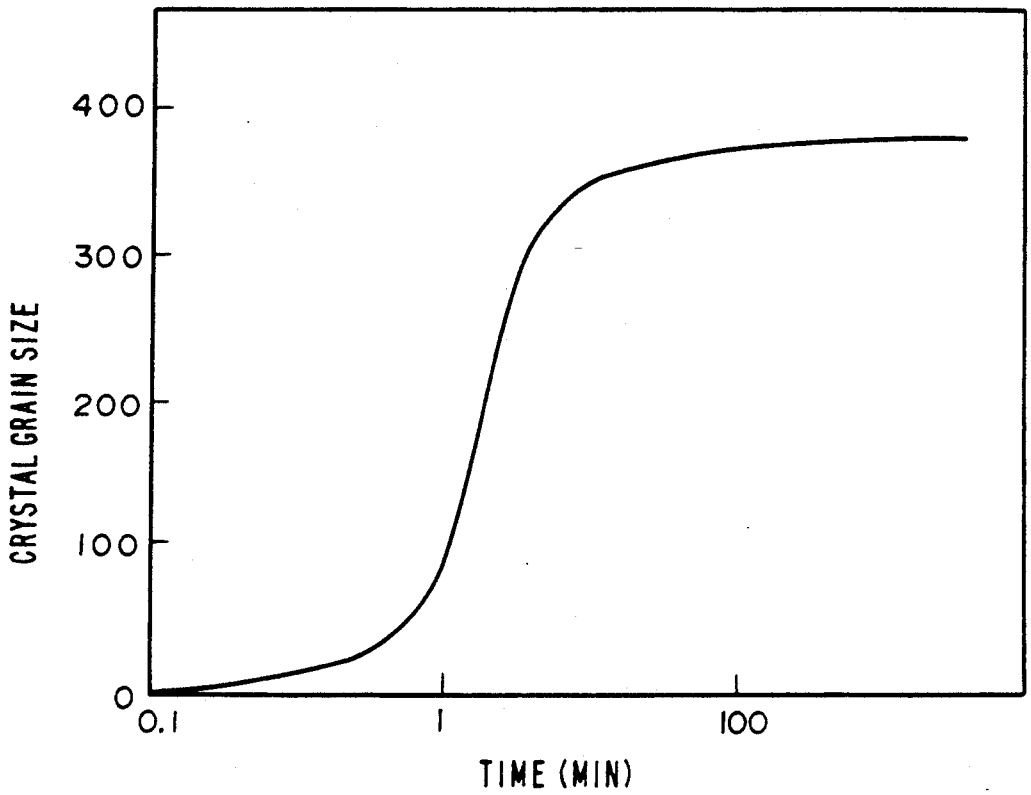
FIG. 9 is a graph showing the relationship between residence time in cathode compartment and the size of precipitated silver grains.

FIG. 9 shows the relationship between the residence time in the cathode compartment and the size of silver grains precipitated for the case where electrolysis was performed at a current density of 20 A/dm$^2$ and at a current concentration of 30 A/L. A certain value of the size of silver grains precipitated means that at least 75% of the total weight of silver has a size of that value or more. As FIG. 9 shows, the residence time in cathode compartment is preferably at least 1 min but not longer than 60 min. If the residence time in cathode compartment is shorter than 1 min, silver ions are merely reduced to form silver grains, which will not agglomerate to produce larger crystal grains. Even if the residence time is longer than 60 min, the difference between the rate of reduction of silver ions and the rate at which the crystallized silver grains re-dissolve chemically in the cathode compartment is substantially lost, whereby it becomes difficult for the silver crystals to grow in size.

EXAMPLE 2

Silver recovery was performed as in Example 1 except that the type of diaphragm was changed to (A), (B), or (C) as shown below. The concentration of thiosulfate ions was measured with the solution being allowed to pass through the diaphragm in varying amounts. At the same time, the resistance of the diaphragm was measured with its thickness and electric resistance varied.

Diaphragm (A): Nafion #315 ion-exchange membrane (DuPont)

Diaphragm (B): PP fiber sintered sheet (thickness, 3 mm; porosity, ca. 60%; pore size, ca. 10 μμm)

Diaphragm (C): conventional Tetron ® fabric.

Figure 6:
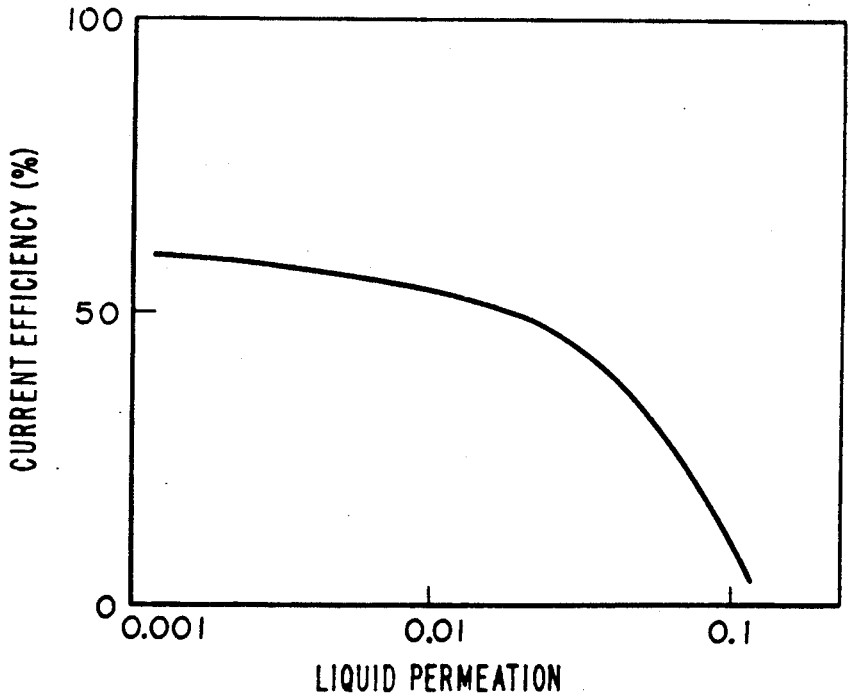
FIG. 6 is a graph showing the relationship between the amount of liquid permeation through a diaphragm and the current efficiency for silver recovery.
Figure 5:
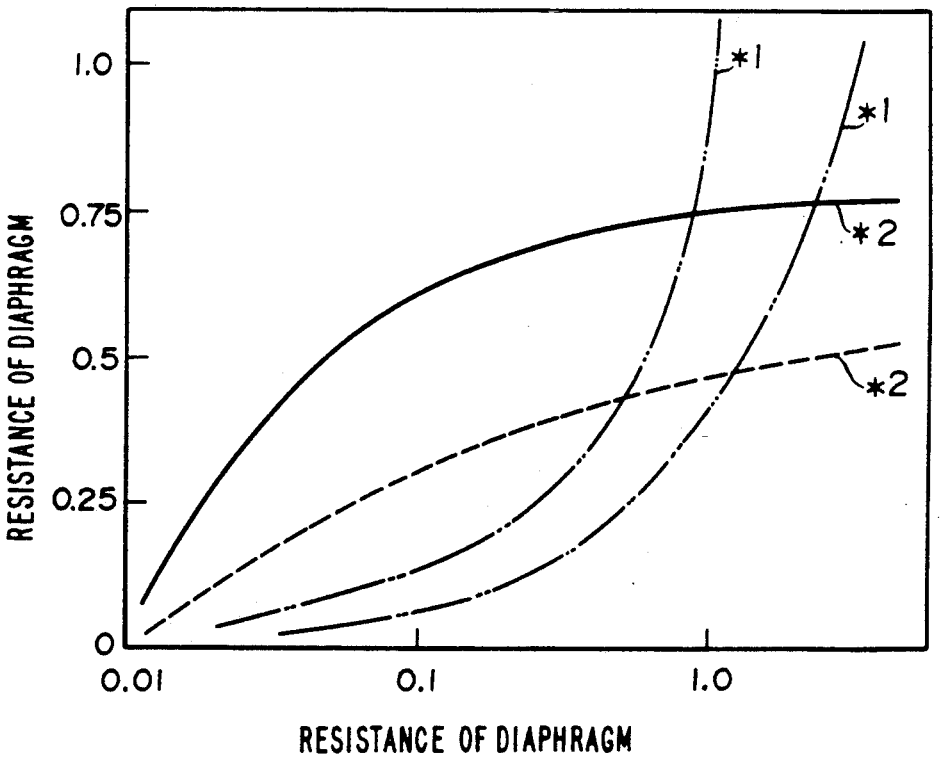
FIG. 5 is a graph showing the relationship between the calculated and measured resistances of a diaphragm.

The test results are shown in FIG. 4–6 and Table 1. FIG. 4 shows the relationship between the amount of liquid permeation through diaphragm and the concentration of thiosulfate ions at an electric resistance of $$0.02\ \frac{V \cdot cm^2}{mm \cdot Amp}.$$

The amount of liquid permeation through diaphragm is preferably $$0.1\ \frac{ml}{HR \cdot cm^2} \cdot \frac{1}{atm}$$

or below, more preferably $$0.01\ \frac{ml}{HR \cdot cm^2} \cdot \frac{1}{atm}$$

or below. If the amount of liquid permeation through diaphragm is small enough, the anolyte in the anode compartment is completely separated from the catholyte in the cathode compartment, whereby more of the thiosulfate ions which are an anionic component will be collected in the anode compartment whereas more of the silver ions which are a cationic component will be collected in the cathode compartment. Hence, the precipitation of silver by the intended cathodic reaction is facilitated by a sufficient degree to enable the prevention of silver sulfide formation which would otherwise occur by the cathodic reaction of silver thiosulfate.

FIG. 5 shows the relationship between the calculated and measured resistances of a diaphragm for the two cases where the diaphragm had thicknesses of 1.0 mm and 2.0 mm.

Provided that the symbol *1 in FIG. 5 shows a curve in the case of using diaphragm (A), and the symbol *2 a curve in the case of using diaphragm (C)

The electrical resistance of the diaphragm is preferably $$0.4\ \frac{V \cdot cm^2}{mm \cdot Amp}$$

or below, more preferably $$0.02\ \frac{V \cdot cm^2}{mm \cdot Amp}$$

or below. In actual operations of electrolysis, the membrane resistance of the diaphragm decreases and so does the power consumption, which is preferred for the purposes of the present invention. The membrane resistance of diaphragm was expressed in terms of the potential difference measured across the diaphragm.

FIG. 6 shows the relationship between the amount of liquid permeation through the diaphragm and the current efficiency for silver recovery. As the amount of liquid permeation through the diaphragm becomes $$0.1\ \frac{ml}{HR \cdot cm^2} \cdot \frac{1}{atm}$$

or below, the current efficiency for silver recovery will increase, and below $$0.01\ \frac{ml}{HR \cdot cm^2} \cdot \frac{1}{atm},$$

the current efficiency levels off. This is because the diaphragm is capable of effective separation of thiosulfate ions and because the power consumption by the redox reaction of iron ions in EDTA-Fe-$NH_4$ is sufficiently decreased by the diaphragm to prevent the decrease in the current efficiency for silver recovery.

By changing the amount of liquid permeation through diaphragms, the proportions of Ag and $Ag_2S$ produced and the amount of $H_2S$ generation can be varied as shown in Table 1 below.

TABLE 1

Amount of Sulfides Produced at Cathode

| | Weight ratio of Ag to $Ag_2S$ | $H_2S$ generation, ppm |
|---|---|---|
| Cation-exchange membrane | 6.7 | <1.0 |
| PP fiber sintered sheet | 3.6 | 1–2 |
| Tetoron ® fabric | 1.8 | 5–10 |
| Diaphragm-free | 0.9 | ca. 20 |

One can see from Table 1 that in order to perform efficient silver recovery, a polypropylene fiber sintered sheet is preferably used as a diaphragm for electrolysis and more preferably a cation-exchange membrane is used.

As described on the foregoing pages, a waste photographic processing solution is electrolyzed with the current density at cathode and the current concentration in the cathode compartment controlled in such a way that the silver ions in the waste solution are reduced by means of small hydrogen bubbles that are generated by the electrolytic reaction with the waste solution being agitated or fluidized constantly. This procedure insures that the reduced silver grains will be precipitated in the solution in the cathode compartment, with little precipitation occurring on the cathode surface. Thus, unlike in the prior art method of electrolytic reduction, there is no need for forcefully separating precipitated silver from the cathode plate by physical or mechanical means. This eliminates the need for interrupting the electrolytic operation, so that the silver grains produced can be recovered by separation through filtration with great ease, as a result of which efficient silver recovery can be accomplished through continuous operation without shutting down or disassembling the recovery apparatus.

If the current density at cathode is adjusted to at least 1 A/dm$^2$ and the current concentration in cathode compartment adjusted to at least 10 A/L, and if the generation of hydrogen at cathode is facilitated by constructing the cathode of any one of the carbonaceous materials described herein, silver ions in a waste photographic processing solution can be reduced with high current efficiency and high percentage of silver recovery to form silver grains in the solution per se.

If the residence time of the waste solution in the cathode compartment is adjusted to lie between 1 and 60 min, the silver grains produced in the waste solution in the cathode compartment can be grown to a sufficiently large size to be readily recovered by a simple method such as one using an ordinary filter.

Further, the electrolytic cell used in the present invention is divided into a cathode and an anode compartment by a diaphragm that is permeable to ions but which is impermeable to waste photographic processing solutions. The diaphragm is effective not only in preventing excessive inflow of thiosulfate ions into the anode compartment which would otherwise lead to the generation of silver sulfide but also in preventing the inflow of sulfides into the cathode compartment from the anode compartment where they are formed. As a result, the generation of silver sulfide which will retard the growth of silver crystals or which is difficult to separate by filtration is reduced whereas the formation of silver grains is promoted to further facilitate the intended recovery of silver with high current efficiency and high percentage of silver recovery.

Thus, in accordance with the present invention, silver grains are precipitated in the catholyte, not on the cathode plate as in the prior art, and this eliminates the need for interrupting the electrolytic operation, whereby the silver grains produced can be recovered by separation through filtration.

If the amount of liquid permeation through the diaphragm is adjusted to $$0.1\ \frac{\text{ml}}{\text{HR}\cdot\text{cm}^2}\cdot\frac{1}{\text{atm}}$$

or less and if its electric resistance is adjusted to $$0.4\ \frac{\text{V}\cdot\text{cm}^2}{\text{mm}\cdot\text{Amp}}$$

or below, the diaphragm acquires selective ion permeability (i.e. less permeable to waste photographic processing solutions) and prevents not only the formation of sulfides but also the decrease in current efficiency which would otherwise occur on account of increased power consumption by the redox reaction of EDTA-Fe-$NH_4$. Thus, the diaphragm that satisfies the conditions set forth above is preferred for the purpose of recovering silver from waste photographic processing solutions with high efficiency.

What is claimed is:

1. A method of recovering silver from a waste photographic processing solution, which comprises supplying the waste photographic process solution into a cathode compartment of an electrolytic cell which has a cathode and is separated from an anode compartment by a diaphragm, performing electrolysis with a current density at the cathode of at least 1 A/dm$^2$ and a current concentration in the cathode compartment of at least 10 A/L, said current density and said current concentration being controlled in such a way that silver ions are reduced in said waste photographic processing solution with the hydrogen bubbles evolved by electrolytic reaction, and precipitating the reduced silver ions as silver grains in the waste photographic processing solution.

2. A method according to claim 1 wherein the silver ions in the solution in said cathode compartment are reduced by contact with the hydrogen bubbles evolved by electrolytic reaction while said solution is being agitated.

3. A method according to claim 1 wherein the electrolysis is performed with the waste photographic processing solution being circulated in said cathode compartment.

4. A method according to claim 3 wherein the electrolysis is performed with the residence time of the circulating waste photographic processing solution being adjusted to lie between 1 and 60 minutes.

5. A method according to claim 1 wherein the silver grains formed in the cathode compartment are separated and recovered either continuously or intermittently by at least one means selected from among filtration, centrifugation and sedimentation.

6. A method according to claim 1 wherein the electrolysis is performed with the current density at the cathode of at least 10 A/dm$^2$ and the current concentration in the cathode compartment of at least 100 A/L.

7. A method according to claims 1 wherein said electrolysis is performed with a diaphragm which is permeable to ions but substantially impermeable to the waste photographic processing solution as well as to a solvent.

8. A method according to claim 1 wherein said electrolysis is performed with a diaphragm which permits the passage of a liquid in an amount of no more than $$0.1\ \frac{\text{ml}}{\text{HR}\cdot\text{cm}^2}\cdot\frac{1}{\text{atm}}$$

and which has an electric resistance of no more than $$0.4\ \frac{\text{V}\cdot\text{cm}^2}{\text{mm}\cdot\text{Amp}}.$$

9. A method according to claim 1 wherein said electrolysis performed with a diaphragm which permits the passage of a liquid in an amount of no more than $$0.01\ \frac{\text{ml}}{\text{HR}\cdot\text{cm}^2}\cdot\frac{1}{\text{atm}}$$

and which has an electric resistance of no more than $$0.02\ \frac{\text{V}\cdot\text{cm}^2}{\text{mm}\cdot\text{Amp}}.$$

10. A method according to claim 1 wherein the cathode in said cathode compartment is made of a carbonaceous material which is optionally coated with a small amount of a platinum group metal or an oxide thereof.

11. A method according to claim 10 wherein said carbonaceous material is graphite or activated carbon.

* * * * *